United States Patent [19]

Hettman

[11] 4,418,969

[45] Dec. 6, 1983

[54] BOTTLED CHEMICAL HANDLING SYSTEM

[76] Inventor: Kenneth R. Hettman, 833 Alpine Ave., Burlingame, Calif. 94010

[21] Appl. No.: 219,688

[22] Filed: Dec. 24, 1980

[51] Int. Cl.[3] ..... A47B 73/00; A47B 91/00

[52] U.S. Cl. ..... 312/250; 312/229; 312/292; 211/74

[58] Field of Search ..... 312/250, 253, 291, 292, 312/293, 42, 72, 35, 128, 234.4, 333, 229; 211/72, 74

[56] References Cited

U.S. PATENT DOCUMENTS

| | | | |
|---|---|---|---|
| 177,207 | 5/1876 | Chandler | 312/229 |
| 188,512 | 3/1877 | Harlow | 312/234.4 |
| 593,312 | 11/1897 | Schandein et al. | 211/74 |
| 753,979 | 3/1904 | Hall | 312/229 |
| 1,729,182 | 9/1929 | Osborn | 312/291 |
| 1,929,542 | 10/1933 | Vandervoort | 312/284 |
| 1,973,854 | 9/1934 | Hoffman et al. | 211/74 |
| 2,057,617 | 10/1936 | Keith | 312/253 |
| 3,204,867 | 9/1965 | Wahlbom | 211/74 |
| 3,269,788 | 8/1966 | Kneer | 312/234.4 |
| 3,445,150 | 5/1969 | Bartarian | 312/229 |
| 4,023,681 | 5/1977 | Plant | 211/74 |
| 4,191,296 | 3/1980 | Morgan | 312/45 |
| 4,196,953 | 4/1980 | Krakow | 312/291 |
| 4,282,977 | 8/1981 | Dilorenzo | 211/74 |
| 4,288,134 | 9/1981 | Knaack et al. | 312/DIG. 33 |

FOREIGN PATENT DOCUMENTS

| | | | |
|---|---|---|---|
| 561144 | 3/1975 | Switzerland | 312/250 |
| 330135 | 6/1930 | United Kingdom | 312/128 |
| 388113 | 2/1933 | United Kingdom | 211/74 |
| 394433 | 6/1933 | United Kingdom | 312/45 |

*Primary Examiner*—Victor N. Sakran

*Attorney, Agent, or Firm*—Townsend and Townsend

[57] ABSTRACT

A bottled chemical handling system having an outer protective housing for supporting an inner shelving and containment module. The inner containment module is provided with a series of bottle shelves arranged at compound angles with respect to horizontal so as to prevent rolling motion of bottles stored on the shelves and to enable any spilled liquid to drain to the rear of the inner module and then down into a sump region at the lower back portion of the inner module. A drain vent interconnects the sump region within the module to the outside of the protective housing, while a fume vent provides a fluid path from the module interior to ambient.

The system is provided with castors and a locking foot to facilitate transportation of the system between locations and to stabilize the system when in place.

A wide variety of bottle sizes can be stored in the inner module on the angled shelves or on an additional bottom shelf.

14 Claims, 8 Drawing Figures

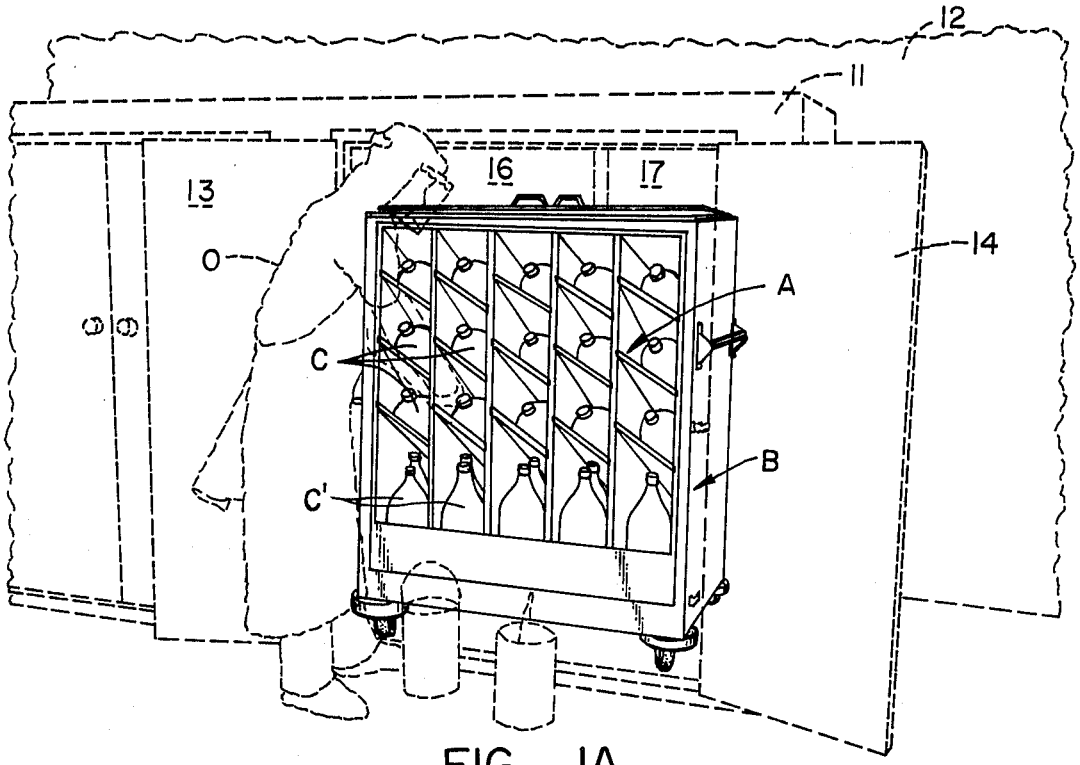
FIG._IA.
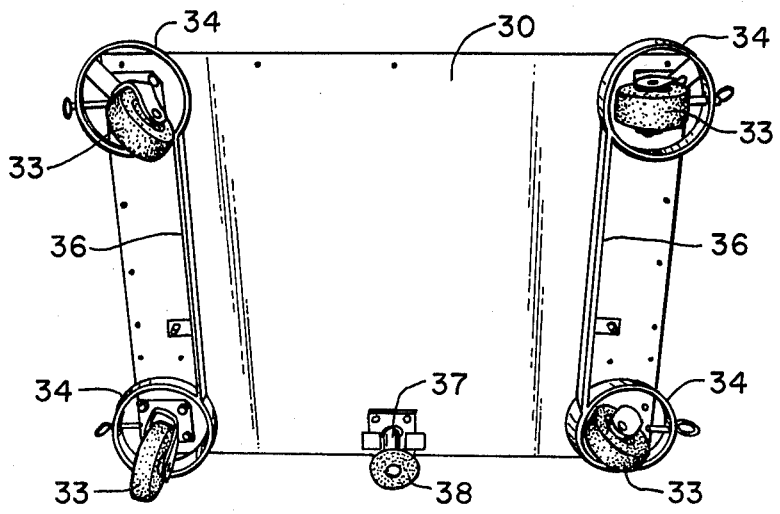
FIG._4.

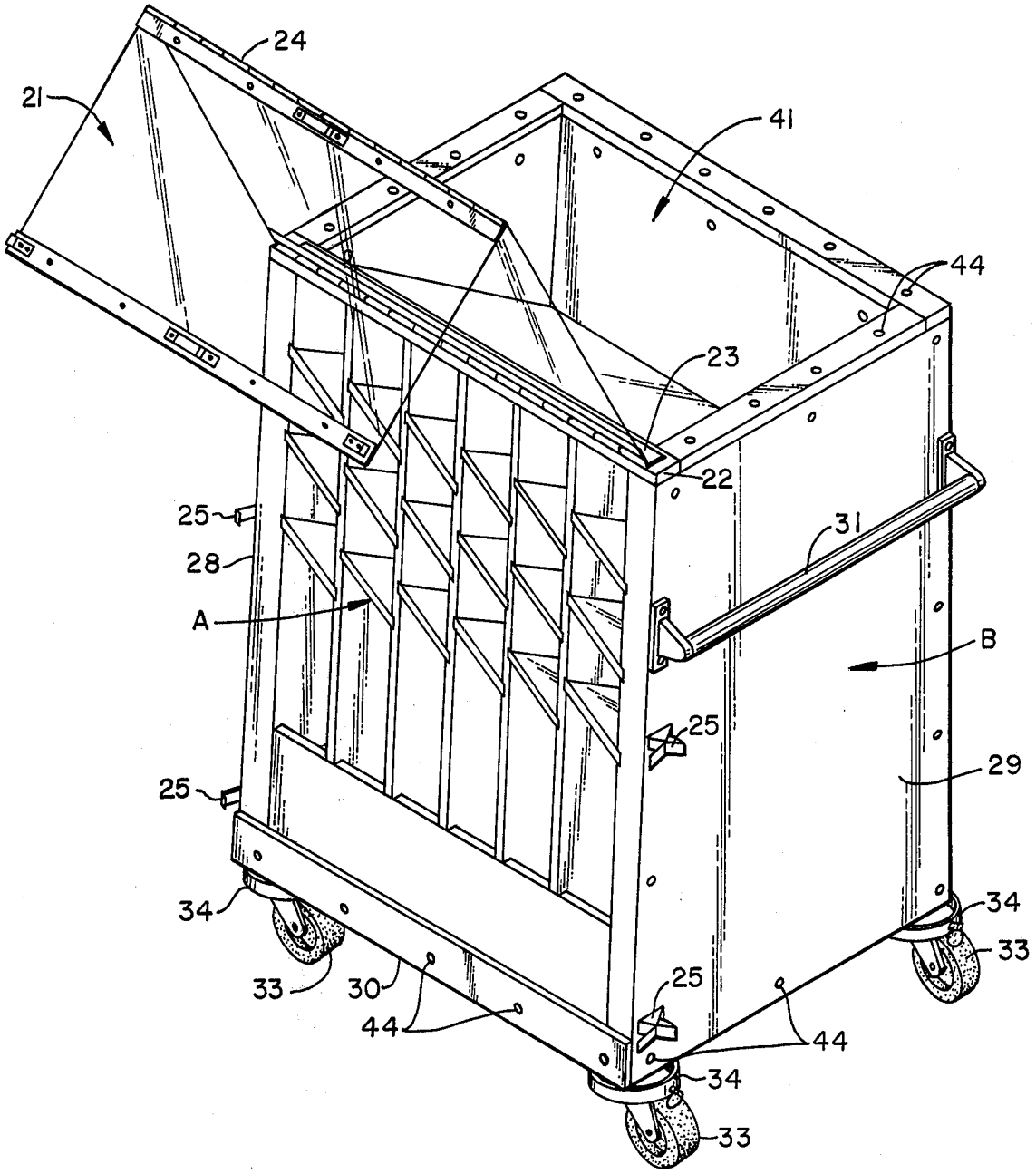
FIG._IB.

BOTTLED CHEMICAL HANDLING SYSTEM

BACKGROUND OF THE INVENTION

This invention relates to chemical handling systems generally, and specifically to systems for handling bottled chemicals.

Many industries employ chemicals in connection with daily activities, such as manufacturing, processing materials, and the like. Many such chemicals are highly toxic, caustic or otherwise dangerous, and must be stored, transported and dispensed with great caution and safety. In addition, some chemicals are extremely expensive and must be subjected to high level security to prevent theft. The caution, safety and security requirements for many bottled chemicals are exacerbated by the fact that some chemicals must be stored in vented containers, which precludes storage and transport in other than a vertical attitude. Finally, in many applications for bottled chemicals, there is a frequent need to inventory the stocks of different types of bottled chemicals, in order to maintain a sufficient supply.

SUMMARY OF THE INVENTION

The invention comprises a bottled chemical handling system which greatly facilitates the storage, transport, handling and display of a wide variety of bottle sizes, both vented and unvented, and which provides great safety in the handling in general of bottled chemicals.

The chemical handling system comprises two major components: an inner bottle shelving and containment module and an outer protective housing which, in the preferred embodiment, is completely mobile so that the system may be moved from location to location within a plant facility without the need for skilled expertise. The inner containment module includes an open front cabinet having a top, a bottom, a back and two sides, and a plurality of bottle storage locations within the module. The bottle storage locations are defined by a plurality of laterally spaced, vertically arranged partitions extending generally from front to back of the housing, a plurality of shelves received between adjacent partitions and arranged at a first predetermined angle with respect to a plane parallel to the bottom, the shelves extending toward the back of the housing in a downwardly sloping manner at a second predetermined angle. The rear margins of the shelves terminate at a distance from the inner surface of the back of the housing in order to provide a fluid flow space therebetween. The shelves are provided with limit stops for bottles to be placed thereon, the limit stops comprising either a laterally extending rod positioned adjacent the rear margin of an associated shelf, a flange positioned at a predetermined location along the associated shelf and extending laterally of one of the partitions, or a combination of both. The inner bottom surface of the module functions as an additional storage shelf which permits chemical containing bottles to be stored in a generally vertical attitude.

The compound angling of the shelves, in combination with the vertical partitions, permits secure storage for bottles of a wide variety of shapes and diameters, the bottles normally resting in two point line contact with the corresponding shelf and the adjacent partition which is joined to the shelf at an acute angle, and the bottom of each bottle in further contact with the associated limit stop. The rearwardly extending downward slope functions to enable bottles to be stored at a predetermined angle with respect to horizontal so that the level of liquid in the bottle does not extend into the mouth and cap portion, thereby reducing or completely eliminating the possibility of leakage of the bottled chemical through the neck and cap. In addition, in the event of bottle breakage during storage or transport, the slope of the shelves ensures that the liquid will drain away from the point of contact of the bottle and down toward the back of the inner containment module, and then downwardly into the sump region at the junction between the bottom of the back and the rear margin of the module bottom.

The outer protective housing comprises an open front housing having a top, a bottom, a back and two sides, and a plurality of supports for enabling the module to be removably supported within the outer protective housing. The support members are arranged in such a manner that the inner containment module is tilted toward the rear of the housing at a slight angle, so that any spilled chemical liquids will accumulate in the sump region of the inner containment module. To facilitate extraction of any spilled liquids, a drain vent is installed through the side walls or the back walls of the outer protective housing and the inner containment module adjacent the sump region. In those applications in which the same chemical is stored in all the bottles, or in which intermixing of different types of spilled chemicals is not a danger, the sump region extends across the entire width of the inner containment module at the bottom rear inside edge. However, in other applications in which intermixing of spilled chemicals cannot be tolerated, the vertical partitions can be used to divide the sump region into a plurality of separate compartments, and a plurality of drain vents are employed.

The outer protective housing is provided with a front door, which is preferably transparent to facilitate visual inspection of the inner containment module contents for inventory and safety purposes. Preferably, the door is mounted with a double hinged arrangement permitting the door to be folded and stacked on the top of the outer protective housing prior to use of the system.

The outer protective housing may also include a top storage bin for any desired articles, such as chemical neutralizers required in the event of a spill, a fire extinguisher, or the like. In an optional embodiment, a fume vent is provided which extends through the top of the outer protective housing and into the interior of the inner containment module to provide an exhaust path from the interior of the module.

The bottled chemical handling system comprising the outer protective housing and the inner containment module is made mobile by the provision of a plurality of casters or equivalent rolling support devices to facilitate movement of the system from one location to another. Preferably, a position floor lock is also secured to the underside of the bottom of the outer protective housing to stabilize the system at a particular location. In order to protect the casters from damage during handling (e.g. by insertion of a fork lift), each caster is provided with a surrounding protective bumper. To facilitate forklift handling, a laterally spaced pair of sturdy forklift guides are mounted slightly inboard of the casters extending from front to back.

The chemical handling system of the invention is ideally suited for use within a structure in combination with a "pass through" double door arrangement. In such an arrangement, a storage area is provided at the location where the chemicals are normally stationed (e.g. a laboratory) with locking doors facing into the room. In addition, on the other side of the wall in a common hallway, for example, an additional pair of locking double doors are installed. In use, the chemical handling system is wheeled from a starting location to the hallway doors, the hallway doors are opened and the folding outer protective housing door is raised to the open position. Next, the system is wheeled into the protective laboratory enclosure, after which the hallway doors are closed and locked. Thereafter, workers in the laboratory may gain access to the bottled chemicals by unlocking and opening the inner doors.

For a fuller understanding of the nature and advantages of the invention, reference should be had to the ensuing detailed description taken in conjunction with the accompanying drawings.

BRIEF DESCRIPTION OF THE DRAWINGS

FIG. 1A is a schematic view showing the chemical handling system in situ with the surrounding details illustrated in broken lines;

FIG. 1B is a perspective view of the invention with the front door partially raised;

FIG. 4 is a bottom view of the invention;

DESCRIPTION OF THE PREFERRED EMBODIMENTS

Figure 2:
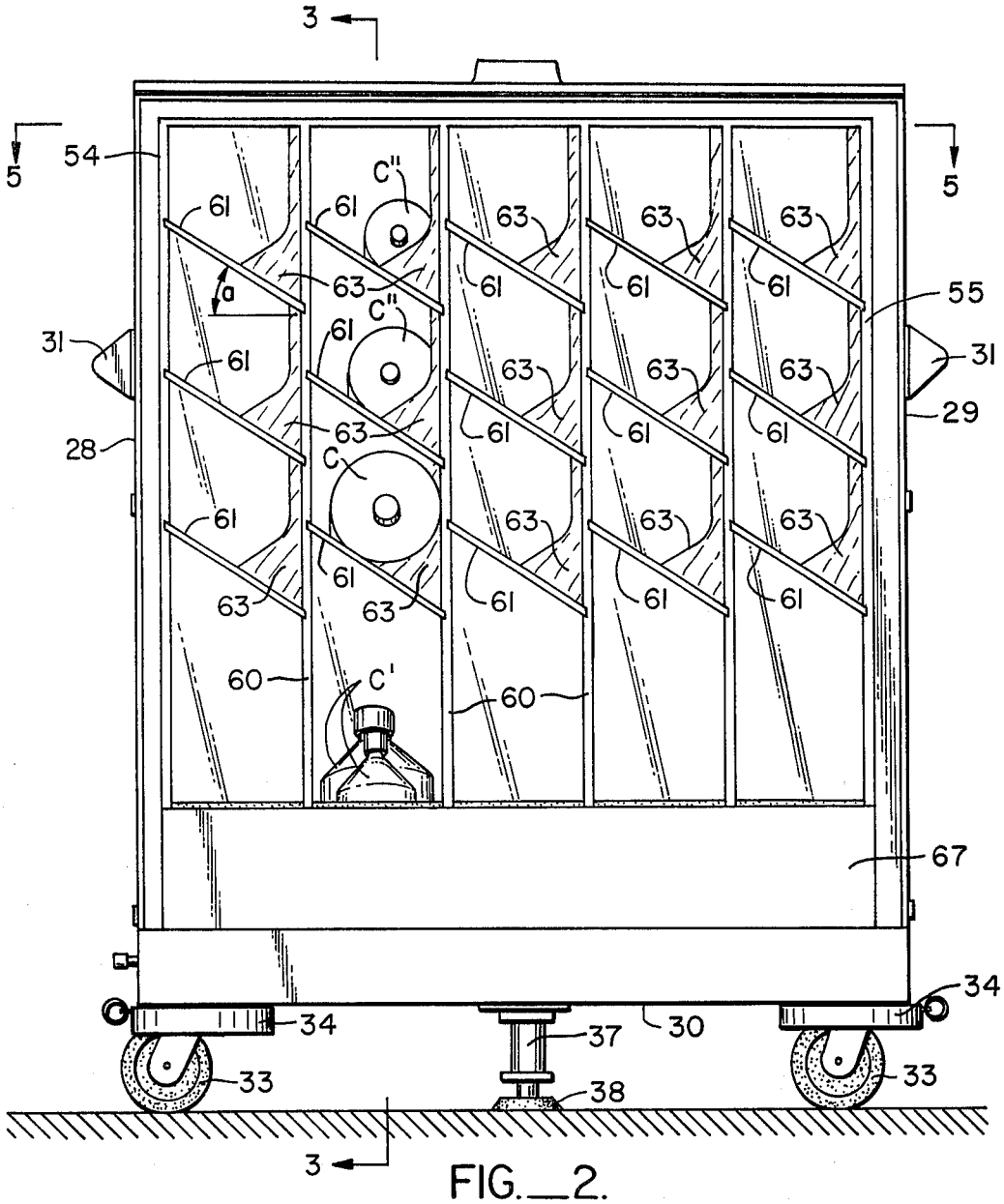
FIG. 2 is a front plan view illustrating the invention locked in place.

Turning now to the drawings, FIG. 1A illustrates a bottled chemical handling system constructed according to the invention, the invention being shown in solid lines and the operating environment being shown in broken lines; while FIG. 1B illustrates the system alone in perspective format. As seen in thse drawings, the invention comprises two major components: an inner containment module generally designated with the reference character A and an outer protective housing generally designated with the reference B. In FIG. 1A, the invention is illustrated in one possible operating environment configured as a "pass through" system. A stationary cabinet structure 11 extends from a partition wall 12 a sufficient distance to accommodate the chemical handling system of the invention. A pair of closure doors 13, 14 conceal and protect the system when not in use. Preferably, doors 13, 14 should be provided with a suitable high security lock. As further evident in FIG. 1A, the system comprising major components A and B stores a plurality of chemical containing bottles C, C' which are accessible to an operator O when the doors 13, 14 are in the illustrated open position. Bottles C are arranged to be stored in a slanted attitude, while bottles C' are stored in a generally vertical attitude.

The facing walls in FIG. 1A are typically located in a chemical use room, such as a laboratory. The "pass through" system further includes a pair of doors 16, 17 (partially visible in FIG. 1A) which open to an adjacent area, such as a common hallway. The system A, B is transported from a remote location to the interior of cabinet 11 through doors 16, 17, and is likewise removed to a remote location through these same doors.

As best seen in FIG. 1B, the outer protective housing B is provided with a double hinged folding door 21, preferably fabricated from transparent plastic to permit viewing of the interior contents of the system. Door 21 is secured to the front frame portion 22 of housing B by means of a hinge 23 which affords 270° rotation to door 21. A second hinge 24 permits the door 21 to be folded flat on the top surface 22 when the system is ready for use. A plurality of door latches 25 are secured to the front margin of housing side walls 28, 29 and serve to retain door 21 in a snugly closed attitude during transportation and out of service storage. Side mounted handles 31 are provided for ease of handling of the system during transport in the manner described below.

Secured to the bottom 30 of outer protective housing B are four casters 23, which are preferably swivel-lock casters having up to four locking positions. Surrounding each caster 33 is a protective bumper 34 which prevents mechanical damage to the associated caster, particularly during handling of the system by a forklift or other heavy moving equipment. In addition, to facilitate forklift handling, bottom 30 is provided with a pair of forklift guides 36 (FIG. 4) slightly inboard of casters 33 and extending from front to back of the outer protective housing. A conventional vertically adjustable floor lock 37 having a pressure foot 38 is also secured to bottom 30 of the housing B to lock the system in place (e.g., when positioned in cabinet 11).

Figure 3:
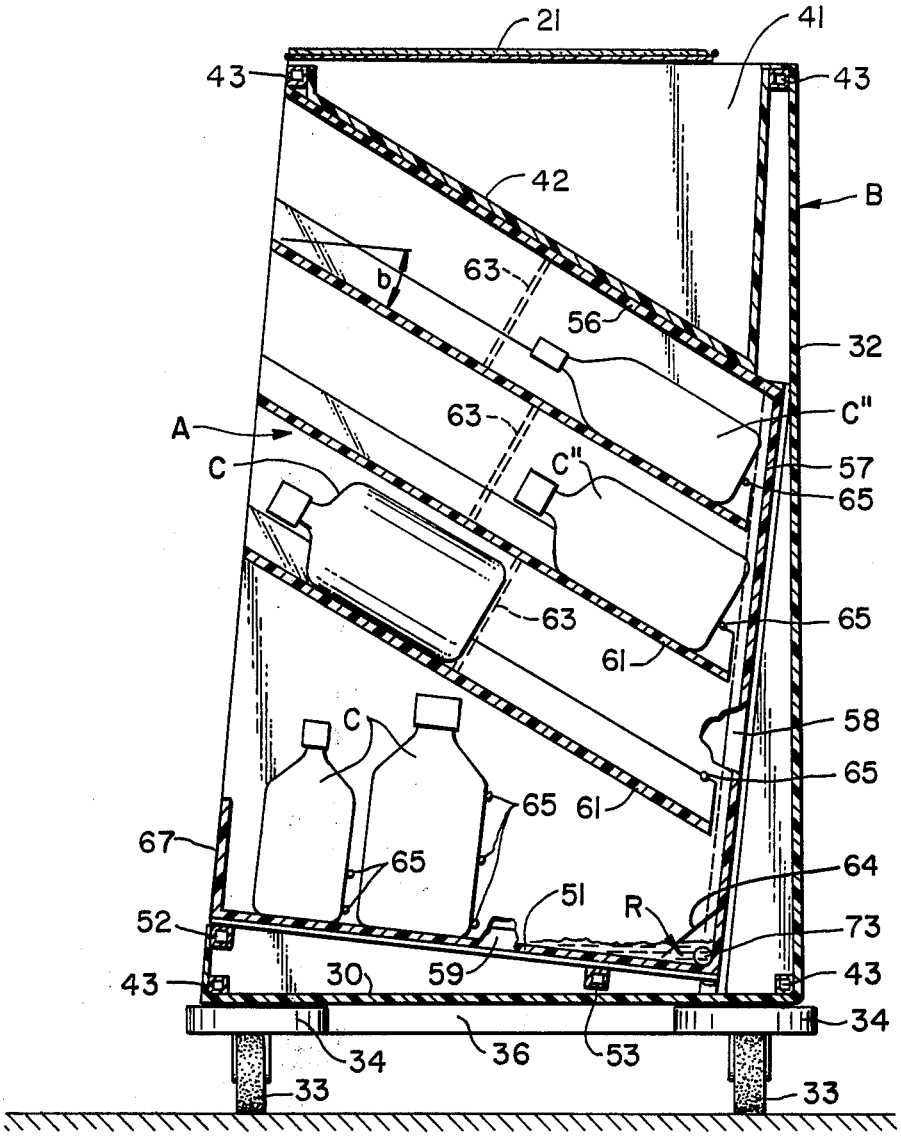
FIG. 3 is a sectional view taken along lines 3—3 of FIG. 2.

As best seen in FIGS. 1B and 3, a storage bin 41 is formed in the upper end of outer protective housing B in order to provide easy access to materials ancillary to the operation of the system, such as chemicals for neutralizing the activity of spilled liquids, fire extinguishers or the like. If desired, a top closure may be provided for bin 41.

As best shown in FIGS. 1B and 3, the side, back and bottom portions of outer protective housing B are secured together to form a rigid structure by means of frame members 43, which are preferably sections of steel tubing, and machine screw fasteners 44 passing through the housing panels from the outside and threaded into corresponding apertures in the tubing frames 43.

Figure 5:
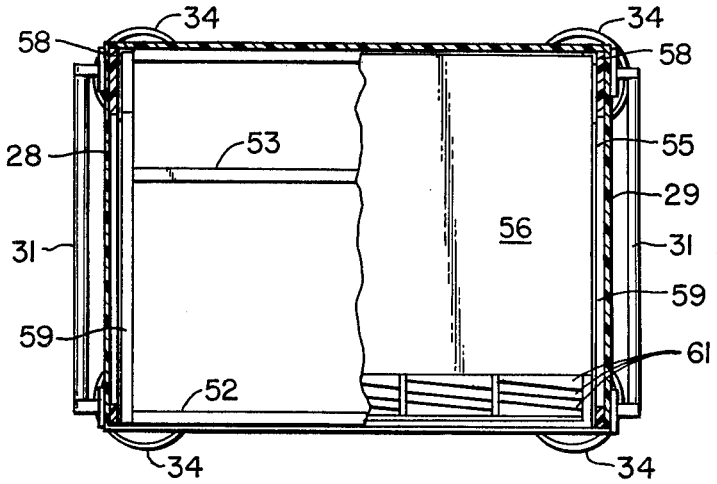
FIG. 5 is a partial sectional top view of the invention.

The inner shelving and containment module A is removably received in the interior of outer protective housing B, with the bottom 51 resting on a pair of transversely arranged support frames 52, 53 as seen in FIG. 3. Frames 52, 53 are positioned at different heights from the bottom 30 of the outer protective housing, so that module A is tilted toward the back of the housing B by a predetermined angle, preferably about 5° from horizontal. Each rear vertical edge of module A is removably retained in a guide consisting of a right angle channel 58 (see FIGS. 3 and 5) secured to the inner surface of housing side wall 28, 29 and extending along the inner surface at the same angle to the back 32 of housing B as that provided for bottom wall 51 by frames 52, 53. Channel 58 is partially hidden in FIG. 3 and the hidden portion is depicted with broken lines. Module A is supported at the lower side edges by means of a pair of similar channels 59 extending along the inner surface of housing side panels 28, 29 at the same angle to the horizontal as that provided by frames 52, 53. One channel 29 is partially depicted in FIG. 3. The same channel 59 is shown in FIG. 5, which is a compound sectional view looking downwardly from top panel 56 in the right half of the figure and from a point just below the bottom panel 51 in the left half of the figure.

As best seen in FIGS. 2 and 3, module A comprises bottom wall 51, side walls 54, 55, slanted top wall 56, and back wall 57. A plurality of partitions 60 vertically divide the volume within module A into a plurality of rows. Each row is provided with a plurality of bottle storage shelves 61, each of which is secured between adjacent partitions 60 or between a partition 60 and a side wall 54 or 55. An important feature of the invention is that each shelf 61 is mounted at two angles from horizontal: one angle a with respect to a line drawn normal to the partition 60 surfaces (FIG. 2) and another angle b with respect to a line drawn normal to the front edge of module A (FIG. 3). The angle a ensures that any bottle C is nested on its shelf in line contact with a partition 60 and a shelf 61. The angle b is chosed such that a minimum of liquid, or none at all, rests in the neck portion of shelved bottles to minimize the possibility of leakage via the bottle cap. In one specific embodiment of the invention, angle a is 30°, while angle b is 25°. The choice of this value for angle b is made in concert with a tilt angle of 5° for module A, so that each shelved bottle rests at an angle of 30° to the floor.

Each shelf is also provided with at least one limit stop, two versions of which are illustrated in FIGS. 2 and 3. The first type of limit stop comprises a flange 63 extending laterally of the partition 60 and positioned approximately midway along the length of a shelf 61. The second type of limit stop comprises a rod 65 hidden in FIG. 2 but shown in section in FIG. 3 extending transversely of the module A and positioned adjacent the rear margin of the shelf 61. The function of each stop is to limit the position of the associated bottle along the length of the shelf. In addition, the flanged stop 63 has an outer margin contour which enables a bottle C″ to be inserted into a bottle storage location rearwardly of a second bottle C, as depicted in FIG. 3.

Another important feature of the invention is the provision of a flow space between the rear margins of shelves 61 and the inner surface of the rear wall 57 of inner module A. Should a bottle develop a leak, as for example by rupturing, the liquid will flow down the surface of the shelf 61 toward the back of the module A and then flow down into a sump region R shown in FIG. 3 without any splashing. In the embodiment shown, a single sump region R extending across the entire width of the module A is formed by notching the lower rear portion of each partition 60, as shown at 64. Any spilled liquid which collects in the region R can be drained from this region by the provision of a vent described below.

The upper surface of the inner module bottom shelf 51 also serves as a storage shelf for bottles which can only be stored in a generally vertical attitude, such as vented bottles C′. Although the angle to the horizontal of bottom 51 is not nearly so great as that provided by shelves 61, it is useful to provide guide stops for bottles C′, typically in the form of rods 65 extending between adjacent partition walls to provide positional stability for bottles C′.

Inner module A is also provided with an upwardly extending front containment panel 67 which functions as a forward wall for the lowest storage compartment.

Figure 6:
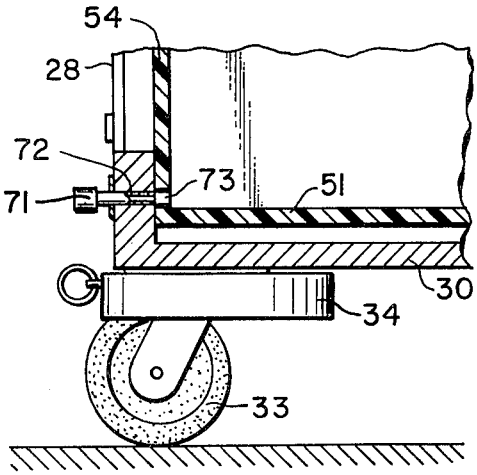
FIG. 6 is an enlarged sectional detail view of the invention.

With reference to FIG. 6, a drain vent tube 71 is received in an aperture 72 in outer housing side wall 28 and an aligned aperture 73 formed in inner module sidewall 54 at the left end of sump region R. Spilled liquid accumulated in region R can be easily drained off through vent 71, when necessary.

In a typical "pass" system such as that illustrated in FIG. 1A, a vent arrangement is usually provided. In such installations, the interior of module A is vented by leaving door 21 in the folded, nested position on the top of housing B, as illustrated. In other installations requiring venting, in which no ancillary venting arrangement is provided, the embodiment of FIG. 7 may be employed.

Figure 7:
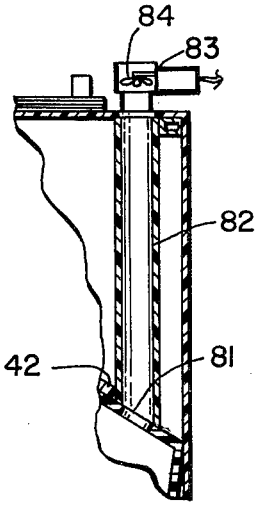
FIG. 7 is a partial detail view taken from FIG. 3 illustrating an alternate embodiment of the invention.

FIG. 7 illustrates an alternate embodiment of the invention in which a fume vent is provided from the interior of inner module A to ambient. As seen in this figure, an aperture 81 is formed through the inner module top wall 56 and upper storage bin lower wall 42, and a vent pipe 82 is connected between aperture 81 and a fume vent outlet housing 83 having a small exhaust fan 84 mounted therein.

In use, after fabrication of the inner module A and outer housing B separately, the inner module is inserted into the outer housing and rested on support frames 52, 53. Ordinarily, the weight of the components comprising inner module A will be sufficient to retain the module in place. However, if desired, suitable fastening devices, such as sheet metal screws, clamps or the like, may be additionally employed to rigidly secure the system together. Next, drain vent 71 is inserted into aperture 72. After assembly, the device is ready for use.

During transport, handles 31 serve as an aid to human operators in maneuvering the system from location to location. It should be noted that, in applications requiring a multiplicity of modules A and housings B, it may be useful to stagger the vertical location of handles 30 from housing to housing, particularly when space is at a premium. Ordinarily, during non-use storage or use storage for systems having the FIG. 7 vent arrangement, door 21 is maintained in the closed latched position; while during use storage such as that depicted in FIG. 1A, door 21 is folded and stacked on the top of the outer housing B.

As will now be apparent, the invention provides a highly useful bottled chemical handling system which affords secure storage for liquid containing bottles in a wide variety of locations. In addition, when the system is being moved from one location to another, the bottles nested on shelves 61 are very secure against motion by virtue of the compound angular support afforded by partitions 60 and shelves 61, and the back stops 65. Moreover, any bottles carried by the bottom panel 51 are also retained against unnecessary movement by means of guide rods 65. In addition, the invention is capable of holding a substantial number of bottles of the same or a wide variety of different sizes, any one of which can be readily removed by an operator. It should be noted that, with the door 21 in the closed position, the bottles within the module may be readily inventoried by simple visual inspection usually without the necessity of opening the door.

Although the invention has been specifically described as a combined two component system, it is envisioned that the inner module A can be used alone in many applications. For example, in an application requiring transport of bottled chemicals from one location to another in a plant, a track type conveyor arrangement might be used in place of the separate mobile cart represented by housing B, with one or more modules A designed to be transported along the conveyor on demand. In addition, module A can be used alone as a stationary storage unit and, in installations wherein liquid spillage is not a concern, the shelves 61 may extend entirely to the inner surface of the back wall 57.

While the above provides a complete disclosure of the preferred embodiments of the invention, various modifications, alternate constructions and equivalents may be employed without departing from the true spirit and scope of the invention. For example, in some applications it may be desirable to segregate the sump region R into individual compartments to prevent intermixing of spilled chemicals from adjacent columns. In such applications, notches 64 are omitted from partitions 60 and separate drain vents should be provided for each such segregated sump region. In addition, in other applications it may not be necessary that the system be secure in situ; in such applications, the locking foot 37 may be eliminated. Moreover, in applications of the invention not requiring mobility, the castors 33 and bumpers 34 can be omitted. Further, while the module A has been shown as having a two bottle capacity for each shelf 61, single bottle versions or other multiple bottle versions may be provided, depending on the storage requirements of a given application. Therefore, the above description should not be construed as limiting the scope of the invention which is defined by the appended claims.

What is claimed is:

1. A bottle containment module comprising a top, a bottom, a back, and two sides;

a plurality of laterally spaced partitions vertically arranged within said module;

a plurality of shelves received between adjacent partitions and arranged at a first predetermined angle with respect to a plane parallel to said bottom and normal to said partitions so that a bottle placed on a shelf normally rests in two point line contact with the shelf and an adjacent partition, said shelves extending toward said back in a downwardly sloping manner at a second predetermined angle so that a bottle placed on a shelf normally rests at said second predetermined angle and is biassed backwardly and downwardly of said module by its own weight; and means providing a limit stop for bottles to be placed on said shelves.

2. The combination of claim 1 wherein at least one of said stops comprises a laterally extending rod positioned adjacent the rear margin of the associated shelf.

3. The combination of claim 1 wherein at least one of said stops comprises a flange positioned at a predetermined location along the associated shelf and extending laterally of one of said partitions.

4. The combination of claim 1 wherein said shelves have rear margins terminating at a distance from said back to provide a fluid flow space therebetween.

5. A bottled chemical handling system comprising:

a bottle containment module having a top, a bottom, a back, and two sides, a plurality of laterally spaced partitions vertically arranged within said module, a plurality of shelves received between adjacent partitions and arranged at a first predetermined angle with respect to a plane parallel to said bottom and normal to said partitions, said shelves extending toward said back in a downwardly sloping manner at a second predetermined angle, and means providing a limit stop for bottles to be placed on said shelves; and an outer protective housing for removably receiving said module, said outer protective housing including a top member, a bottom, a back, and two sides, and a plurality of members for removably supporting said module, said support members being arranged to support said module at a third pre-determined angle with respect to a plane parallel to the bottom of said outer protective housing so that said module is tilted toward the back of said outer protective housing.

6. The combination of claim 5 wherein said outer protective housing further includes a top storage bin.

7. The combination of claim 5 wherein said outer protective housing further includes a front door.

8. The combination of claim 7 wherein said front door is hinged to the front margin of said outer protective housing top member and foldable to an open storage position on said outer protective housing top.

9. The combination of claim 5 wherein said outer protective housing is provided with a plurality of casters on the bottom thereof for facilitating transport of said outer protective housing and said module.

10. The combination of claim 9 wherein said outer protective housing further includes a locking foot member secured to the bottom thereof for securing said outer protective housing and said module in place.

11. The combination of claim 9 further including a plurality of protective bumpers mounted on the bottom of said outer protective housing to protect said casters from mechanical damage.

12. The combination of claim 5 further including a drain vent installed in said outer protective housing and said module to provide fluid access to the lower interior of said module.

13. The combination of claim 5 further including a vent extending through said outer protective housing and said module to provide an exhaust path from the interior of said module.

14. The combination of claim 5 further including a pair of lift guide members extending rearwardly along the bottom of said outer protective housing.

* * * * *